US011455976B2

(12) United States Patent
Klanner

(10) Patent No.: US 11,455,976 B2
(45) Date of Patent: Sep. 27, 2022

(54) METHOD FOR PRODUCING A MUSICAL STRING

(71) Applicant: THOMASTIK-INFELD GESELLSCHAFT M.B.H., Vienna (AT)

(72) Inventor: Franz Klanner, Vienna (AT)

(73) Assignee: THOMASTIK-INFELD GESELLSCHAFT M.B.H., Vienna (AT)

( * ) Notice: Subject to any disclaimer, the term of this patent is extended or adjusted under 35 U.S.C. 154(b) by 110 days.

(21) Appl. No.: 17/079,272

(22) Filed: Oct. 23, 2020

(65) Prior Publication Data

US 2021/0125587 A1 Apr. 29, 2021

(51) Int. Cl.

| | |
|---|---|
| ***G10D 3/10*** | (2006.01) |
| ***G10D 3/22*** | (2020.01) |
| ***B65H 54/70*** | (2006.01) |
| ***B65H 59/00*** | (2006.01) |

(52) U.S. Cl.

CPC ..... *G10D 3/10* (2013.01); *B65H 54/70* (2013.01); *B65H 59/00* (2013.01); *G10D 3/22* (2020.02)

(58) Field of Classification Search

CPC .. G10D 3/10; G10D 3/22; G10D 1/02; G10D 1/08; B65H 54/70; B65H 59/00

See application file for complete search history.

(56) References Cited

U.S. PATENT DOCUMENTS

| | | | | |
|---|---|---|---|---|
| 1,766,776 | A | 6/1930 | Chisholm | |
| 3,605,544 | A | 9/1971 | Kondo | |
| 3,610,084 | A | 10/1971 | Behringer | |
| 1,055,038 | A | 10/1977 | Conklin, Jr. | |
| 4,120,146 | A | 10/1978 | Robin | |
| 4,383,465 | A | 5/1983 | Conklin, Jr. | |
| 6,348,646 | B1 * | 2/2002 | Parker | G10D 3/10 84/297 S |

FOREIGN PATENT DOCUMENTS

| | | | |
|---|---|---|---|
| AT | 505706 | A1 | 3/2009 |
| DE | 2736467 | A1 | 2/1979 |
| EP | 0255763 | A1 | 2/1988 |

(Continued)

OTHER PUBLICATIONS

Austria Application No. A 50925/2019, Office Action dated May 22, 2020, 3 pagess.

(Continued)

*Primary Examiner* — Kimberly R Lockett

(74) *Attorney, Agent, or Firm* — Liang & Hennessey LLP; Brian Hennessey

(57) ABSTRACT

In a method for producing a musical string, wherein at least one first winding element is wound on a string core of the musical string in the form of a helical line around the string core, it is proposed that during the winding of a first longitudinal section of the string core using the first winding element, a first pre-tension is applied to the string core, and during the winding of a second longitudinal section of the string core, which is different from the first longitudinal section, using the first winding element, a second pre-tension, which is different from the first pre-tension, is applied to the string core.

16 Claims, 1 Drawing Sheet

(56) References Cited

FOREIGN PATENT DOCUMENTS

| | | | |
|---|---|---|---|
| ES | 2002505 | A6 | 8/1988 |
| JP | S5395613 | A | 8/1978 |
| JP | S54113319 | A | 9/1979 |

OTHER PUBLICATIONS

Danish Application No. PA 2020 70702, Office Action dated Sep. 21, 2021, 5 pages.
Danish Application No. PA 2020 70702, Office Action dated Jun. 17, 2022, 6 pages.

* cited by examiner

METHOD FOR PRODUCING A MUSICAL STRING

CROSS-REFERENCE TO RELATED APPLICATIONS

The present application claims the benefit of Austrian Patent Application No. A 50925/2017, filed Oct. 25, 2019, entitled "METHOD FOR PRODUCING A MUSICAL STRING", which is incorporated by reference in its entirety.

BACKGROUND OF THE INVENTION

1. Field of the Invention

The invention relates to a method for producing a musical string.

2. Description of the Related Art

Most known musical strings have essentially homogeneous mechanical properties over their length in the playing region. They are stretched on musical instruments, such as violins or guitars, and are used to generate tones in just these musical instruments, wherein the musical string is excited by a musician, for example by bowing or plucking. To excite oscillations of different frequencies, therefore, to generate different tones and timbres, the string is clamped down with shortened length either using the fingers or a mechanical clamp. A shortened string thus results, which has a higher oscillation frequency, since every oscillating string has a natural frequency, which is only dependent on its mechanical properties. The plucking or bowing is solely used to supply energy.

It has proven to be disadvantageous that with shorter gripped string lengths, the sound of the string significantly differs from the sound of the same string with greater oscillating string length. With decreasing oscillating or gripped string length, musical strings generally assume sound character having an increasingly closed or constricted effect. Musical instruments in different frequency ranges, or in musical jargon in different positions, have different sound characters, and different handling properties or a different playing feel for the musician. Since it is often possible in string instruments to excite the same tone on a different string—and therefore also having different length of the respective string—the musical instrument has a different sound character in the same frequency range, depending on which musical string and in which location (position of the hand on the fingerboard) the tone was generated on, whereby the sound character of the relevant musical instrument and the interpretation or playback of a piece of music can suffer.

Furthermore, it has been shown that in particular virtuosos desire special or unusual musical strings to be able to flourish, and the possibilities with respect to sound or playing technology of available musical strings are often not sufficient for true masters. Such musicians could play even better or in a more differentiated way but are often restricted in that conventional musical strings simply do not enable or permit some musical possibilities of expression.

The object of the invention is therefore to specify a method of the type mentioned at the outset, using which the mentioned advantages can be avoided, using which a musical string can be provided which has expanded possibilities for sound setting.

SUMMARY OF THE INVENTION

This is achieved according to the invention by a method for producing a musical string in which at least one first winding element is wound on a string core of the musical string in the form of a helical line around the string core. During the winding of a first longitudinal section of the string core using the first winding element, a first pre-tension is applied to the string core. During the winding of a second longitudinal section of the string core, which is different from the first longitudinal section, using the first winding element, a second pre-tension, which is different from the first pre-tension, is applied to the string core.

Expanded possibilities for setting or specifying the sound in the handling of a musical string thus exist.

A musical string can thus be provided which has expanded sound properties or possibilities in relation to conventional musical strings having a string core, which is subjected to a single constant pre-tension during the entire winding process. Handling, response and lifetime of a musical string can thus be influenced over broad ranges.

Musical strings having special properties can thus be provided. It is thus possible, depending on the specific position of the individual longitudinal sections and the amount of the different pre-tensions, to either provide musical strings which are particularly suitable for being excited by means of bowing or by plucking. Either particularly well-balanced musical strings can thus be provided, or very special musical strings for special applications, in which special properties are required to give the musician the possibility of rising to the highest level of virtuosity of his/her possibility of musical expression.

The invention furthermore relates to a musical string, in particular for bowed and/or plucked instruments.

Therefore, the invention furthermore has the object of specifying a musical string of the above-mentioned type, using which the mentioned disadvantages can be avoided, and which can be produced easily having expanded possibilities for sound setting.

This is achieved according to the invention wherein the musical string has at least one supporting string core, wherein at least one first winding element is wound in the form of a helical line around the string core—while forming adjacent turns. In a first longitudinal section of the musical string, a first contact pressure force or a first distance between the adjacent turns prevails, and in a second longitudinal section, which is different from the first longitudinal section, a second contact pressure force or a second distance between the adjacent turns prevails. The second contact pressure force is different from the first contact pressure force or the second distance is different from the first distance.

Such musical strings have the advantages set forth with respect to the method discussed herein.

The dependent claims relate to further advantageous designs of the invention.

Reference is hereby expressly made to the wording of the patent claims, whereby the patent claims are incorporated at this point by reference in the description and are considered to be reproduced verbatim.

BRIEF DESCRIPTION OF THE DRAWINGS

The invention is described in greater detail below with reference to the appended drawings, in which preferred embodiments are merely illustrated by way of example. In the figures.

DETAILED DESCRIPTION

Figure 1:
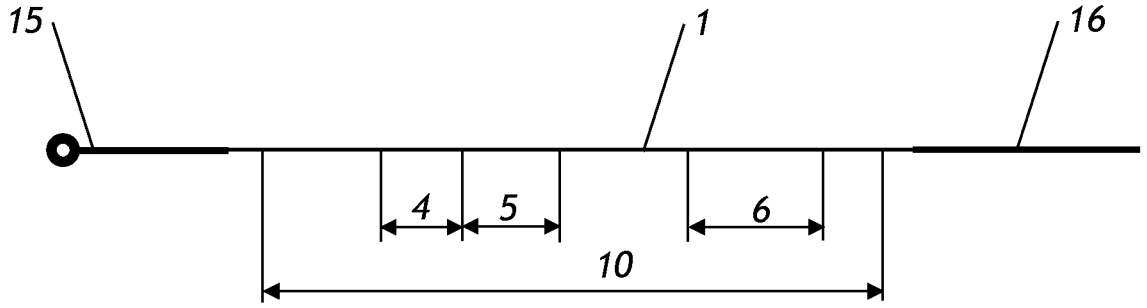
FIG. 1 shows a schematic illustration of a present musical string.
Figure 2:
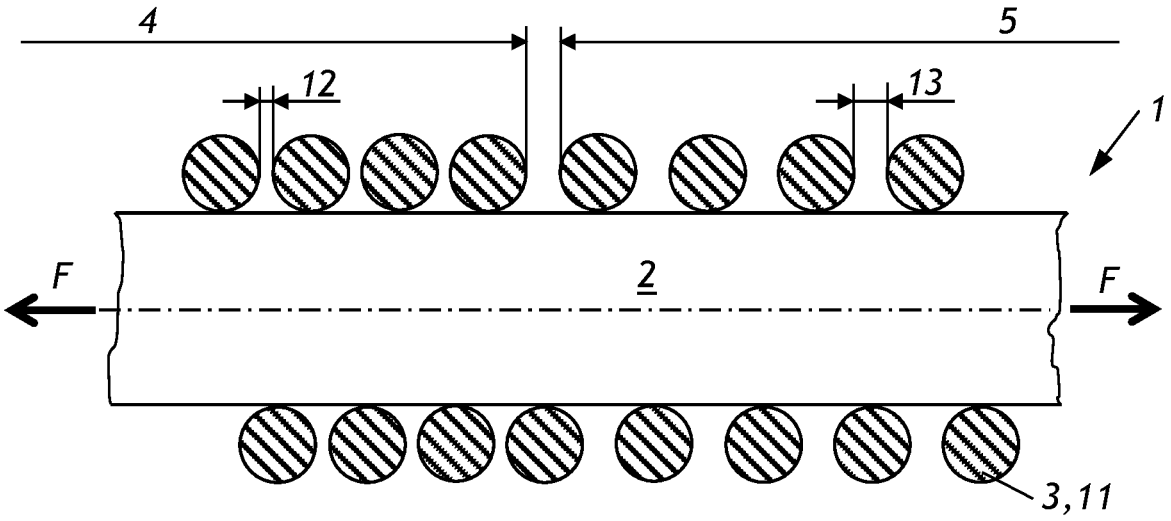
FIG. 2 shows a detail of an embodiment variant of a musical string according to FIG. 1 in a simplified illustration in partial section.

FIGS. 1 and 2 show a musical string 1, in particular for bowed and/or plucked instruments, wherein the musical string 1 has at least one supporting string core 2, wherein at least one first winding element 3—with formation of adjacent turns 11—is wound in the form of a helical line around the string core 2, wherein, in a first longitudinal section 4 of the musical string 1, a first contact pressure force or a first distance 12 prevails between the adjacent turns 11, and wherein, in a second longitudinal section 5, which is different from the first longitudinal section 4, a second contact pressure force or a second distance 13 between the adjacent turns 11 prevails, and wherein the second contact pressure force is different from the first contact pressure force or the second distance 13 is different from the first distance 12.

Expanded possibilities thus exist for setting or specifying the sound and the handling of a musical string 1.

A musical string 1 can thus be provided which has expanded sound properties or possibilities in relation to conventional musical strings 1 having a string core 2, to which a single constant pre-tension is applied during the entire winding process. Handling, response, and lifetime of a musical string 1 can thus be influenced over broad ranges.

Musical strings 1 having special properties can thus be provided. It is thus possible, depending on the specific position of the individual longitudinal sections and the amount of the different pre-tensions, to either provide musical strings 1 which are particularly suitable for being excited by means of bowing or by means of plucking. Either particularly well-balanced musical strings 1 can thus be provided, or very special musical strings 1 for special applications, in which special properties are required to give the musician the possibility of rising to the highest level of virtuosity of his/her possibility of musical expression.

The embodiments illustrated in FIGS. 1 and 2 are depicted in a simplified illustration. The proportions do not have to correspond to the provided real proportions. For better comprehension, individual parts can be shown in a greatly enlarged view or with significantly exaggerated proportions. Furthermore, parts are shown in a sectional illustration in FIG. 2. The courses in the form of helical lines of the turns 11 were not shown here for better clarity of the depiction.

One preferred area of use of such musical strings 1 are the instruments of the violin family, therefore the violin, the viola, the cello, and the bass or contrabass or the bass violin. Further preferred instruments for use of musical strings 1 according to the invention are the viola da gamba and viola d'amore. Furthermore, they can also advantageously be used for guitars. Such musical strings 1 according to the invention can be provided for all bowed and plucked string instruments.

Musical strings 1 according to the invention are provided for generating tone-producing oscillations, wherein a specific type of musical string 1 is provided for use in a specific type of musical instrument, and furthermore have a tuning tone and a so-called tuning weight as features, wherein the tuning tone specifies the natural tone with which a partial longitudinal piece of the musical string 1—within the total length of the musical string 1 between its end regions—oscillates from the length of the scale of the specific type of musical instrument when the musical string 1 is loaded with the tuning weight, therefore is tensioned, and was naturally excited to an oscillation.

Musical strings 1 according to the invention have a string core 2, which is provided and designed to absorb the load or tension which the musical string 1 is subjected to in the state stretched on a musical instrument.

The present musical string 1 preferably has an essentially circular-cylindrical external contour with tensioned musical string 1.

Musical strings 1 for lower tunings generally have wrappings or at least one first winding layer to increase the mass covering of the musical string 1. The natural frequency at which a musical string 1 oscillates is dependent on the oscillating length or scale of the relevant musical string 1, the force with which the relevant musical string 1 is tensioned, and the mass covering of the musical string 1. It is preferably provided that the musical string 1 has at least one first winding layer, which is formed by at least one first winding element 3, wherein the at least one first winding element 3 is wound in the form of a helical line around the string core 2. Multiple winding elements can also form the first winding layer wound adjacent to one another in the form of a multithread helical line.

According to one particularly preferred embodiment—not shown—it is provided that the musical string 1 has at least one second or further winding layer, which is arranged around the first winding layer or between the first winding layer and the string core 2. The second winding layer is formed by at least one second winding element, which is also wound in the form of a helical line around the string core 2. In this case, multiple winding elements can also form the second winding layer wound adjacent to one another in the form of a multithread helical line.

The at least one first winding element 3 or further winding elements of the first or further winding layers is preferably formed as a strip, having essentially rectangular cross section and predeterminable edge formation, wherein it can also be provided that multiple strips are arranged in the form of a multithread helical line in the first or a further winding layer. Furthermore, it can be provided that one or more winding elements are formed as round wire.

It is particularly preferably provided that the at least one round wire or the at least one strip is formed comprising at least one material selected from the group: aluminum, magnesium, iron, chromium, nickel, silicon, silver, gold, platinum, rhodium, copper, tungsten, wherein each of the mentioned materials can be provided as a pure material in the technical meaning or also as a component of an alloy. Musical strings 1 have proven to be particularly advantageous in which the at least one round wire or the at least one strip is formed comprising at least one alloy selected from the group: steel, aluminum-magnesium alloys, aluminum-magnesium-manganese alloys, silver-copper alloys, silver-platinum alloys, silver-rhodium alloys, silver-palladium alloys, and iron-chromium-nickel-silicon-aluminum alloys.

The string core 2 can be formed differently. The string core 2 preferably has an elongation at fracture of at least 3% and/or a modulus of elasticity of less than 80 GPa. A particularly high level of the effect of the present method can thus be achieved.

It is preferably provided that the string core 2 is formed comprising at least one plastic thread and/or a wire cable and/or a natural gut and/or an artificial gut and/or a plastic strip and/or a plastic flat strip. The plastic strips have an essentially rectangular cross section in this case, wherein the string edges can be formed differently, in particular as a so-called natural edge. It is provided in particular that the string core 2 is not formed by a single solid steel wire.

If the string core 2 is formed comprising plastic threads, it is provided in particular that the string core 2 in particular has a predeterminable plurality of plastic fibers. Any type of plastic can be provided per se for the plastic fibers or filaments here, for example comprising polymers, in particular comprising polyamides, aramid, PEK, PAEK, PEEK, PBT, polyester, nylon, polyethylene, PET, PEET, PES, PE, PP, POM, PTFE, PVDF, PVDC, HPPE (high-performance polyethylene), PA, and/or PVC. It can be provided that at least one of the plastic fibers is formed from a self-healing plastic. In such a self-healing plastic, micro-cracks close automatically. The plastic fibers of the string core 2 are the supporting elements of the string core 2 and extend essentially in the longitudinal direction or along the extension of the musical string 1, wherein they can also be screwed in.

Alternatively, it is preferably provided that the string core 2 is formed comprising or from a wire cable. A wire cable is a predeterminable plurality of metal wires, which are made into a cable with one another. A wire cable has a low bending rigidity and—in particular in comparison to a steel wire of comparable cross section—a high elasticity.

The wire cable preferably has an internal core inner cable, and a core outer cable enclosing the core inner cable. The core inner cable has in a first preferred embodiment at least one core inner cable wire, which is wound in the form of a helical line around a center of the wire cable. In a second preferred embodiment, the core inner cable has three core inner cable wires which are wound around the center of the core. The individual core inner cable wires have a predeterminable inner cable lay angle in relation to the longitudinal extension of the musical string 1, which is between 10° and 60°. The core inner cable wires are wound abutting one another in this case in such a way that the core inner cable formed in this way is capable of a high elongation under tensile stress.

In the preferred embodiments of a musical string 1, the core inner cable is enclosed by a core outer cable. The core outer cable has a predeterminable number of core outer cable wires, which are wound or formed into a cable at a predeterminable outer cable lay angle β between 10° and 60° in relation to the longitudinal extension of the musical string 1. It is preferably provided here that the core outer cable comprises six to twelve core outer cable wires. In particularly preferred embodiments of musical strings 1 according to the invention, it is provided that the diameter of the individual core outer cable wires is equal and is greater than the diameter of the core inner cable wires. In particular, such a wire cable has a low bending rigidity and a high extensibility, which can be up to 30% of the original length.

In a present method for producing a musical string 1, it is provided in a known manner that a string core 2 of the musical string 1 is tensioned. The at least one first winding element 3 is wound in the form of a helical line around the string core 2 on the tensioned string core 2. This is usually performed in such a way that the string core 2 is rotatably clamped, and is rotated around its own axis, and simultaneously the first winding element 3 is wound onto the string core 2.

In the known method for producing a musical string 1, the application of the winding layers is performed at a constant pre-tension of the string core 2 during the entire winding process, which is applied by applying a constant force to the string core 2.

It is provided that in the course of the production of the musical string 1, during the application of the first winding element 3, the pre-tension which is applied or will be applied to the string core 2 is varied in a predefinable manner. This means that different longitudinal sections of the musical string 1 are wound at different pre-tension.

It is provided that during the winding of a first longitudinal section 4 of the string core 2 using the first winding element 3, a first pre-tension 7 is applied to the string core 2, and during the winding of a second longitudinal section 5 of the string core 2, which is different from the first longitudinal section 4, using the first winding element 3, a second pre-tension 8 different from the first spring pre-tension 7 is applied to the string core 2. In this case, the first winding element 3 can be a winding element of any arbitrary winding layer. Although it is particularly preferred that the first winding element 3 is wound directly onto the string core 2, possibly only having a damping fluid in between, it can nonetheless be provided that the described process is performed also or only when winding a winding layer other than the innermost one.

The string core 2 is elongated differently due to the different pre-tension. The first winding element 3 is always wound on uniformly in this case, however. Therefore, the change from the first pre-tension 7 to the second pre-tension 8 is preferably performed during the continuous winding using the first winding element 3. The different pre-tension remains unconsidered for the winding process, which takes place precisely as previously.

This has the result that either the forces between abutting turns 11 of the first winding element 3 are different depending on the longitudinal section 4, 5, 6 and the pre-tensions prevailing during the manufacturing, or, if the first winding element 3 was wound loosely in such a way that—in particular in musical strings 1 which are loaded with the tuning weight—distances 12, 13 occur between the adjacent turns 3, as shown in FIG. 2, for example, these distances 12, 13 are different depending on the longitudinal section 4, 5, 6. Therefore, in a first longitudinal section 4 of the musical string 1, a first contact pressure force or a first distance 12 between the adjacent turns 11 prevails, and in a second longitudinal section 5 different from the first longitudinal section 4, a second contact pressure force or a second distance 13 between the adjacent turns 11 prevails. The second contact pressure force is different from the first contact pressure force or the second distance 13 is different from the first distance 12.

It has been shown that the forces which are exerted on the string core 2 by the first winding element 3 wound around the string core 2 are sufficient to fix the respective prevailing longitudinal extension of the string core 2.

The measurement of a distance is trivial per se. However, it can be provided that the musical string 1 is predefinably loaded or impinged, in particular using the tuning weight of the relevant musical string 1, to substantiate the different distances 12, 13.

To substantiate different forces between the turns 11, it is provided in particular that the different penetration depths of a wedge-shaped test piece between the turns 11 are ascertained. In this case, the test piece is pressed with a defined force between the turns 11 normal to the longitudinal extension of the musical string 1. Since it is only necessary here to ascertain one value pair for the comparison, both the exact shape of the test piece and also the size or level of the force are not generally predetermined, but rather are to be selected in each case in such a way that reasonable values can be ascertained in a specific musical string 1. Furthermore, in each case a measurement series having at least five individual measurements and averaging is to be carried out.

Multiple properties of the musical string 1 per longitudinal section 4, 5, 6 are changed or influenced at the same time by the different forces or distances between the turns 11. These are in particular: the mass covering or the density, the damping, and the bending rigidity. Each of these properties already has significant effects on the character of a musical string 1 per se. In that three such important parameters are changed at the same time, this has significant effects on the overall character of the relevant musical string 1.

The mass covering or the density directly influences the tone level. Variations in individual longitudinal regions 4, 5, 6, approximately ±10% around a statistical mean value are achievable, change the character of the musical string 1, and in particular its suitability for specific musical styles.

The bending rigidity is an essential parameter for the number of overtones, and thus the richness of timbre of a musical string 1. In the case of bowing, one "corner" is generated, in the case of plucking, two "corners" are generated, which circulate on the musical string 1. The more pronounced or pointed or sharp these corners are, the more overtones. The properties of these "corners" are in turn dependent on the bending rigidity. The richness of timbre of a musical string 1 can be adapted precisely in detail with specific, gripped lengths or positions by the present measures.

The damping in turn directly influences the suitability of a musical string 1 more for bowing, in which a higher level of damping is required, or for plucking, for which a lower level of damping is desired. Within the same type of excitation, the damping furthermore influences the control possibilities of the musical string 1, and its playing capability or handling properties.

In that only the one parameter "pre-tension" is thus varied during the manufacturing of the musical string 1, immense influence can be exerted on multiple properties of the musical string 1 at the same time. It has proven to be very simple here to vary the pre-tension. In particular, this method is clearly simpler to implement than most other possibilities for finely influencing the mass covering, the damping, and/or the bending rigidity.

Most musical strings 1 have a string core 2 having a constant cross section over the length of the musical string 1. It is particularly preferably provided that the first pre-tension 7 is applied by loading the string core 2 using a first pre-tension force, and the second pre-tension 8 is applied by loading the string core 2 using a second pre-tension force. This is particularly easily implementable since a pre-tension is already applied by loading the string core 2 using a force in known methods. This force now only has to be varied.

Alternatively or additionally to the statement immediately above, it can also be provided that a string core 2 is provided which has a first cross section in the first longitudinal section 4 and a second cross section in the second longitudinal section 5, wherein the first cross section is different from the second cross section. However, this variant is somewhat more complex than solely the variation of the pre-tension force.

The first longitudinal section 4 and the second longitudinal section 5 are preferably formed essentially directly adjoining one another. An almost rapid change of the pre-tension 7, 8, 9 can be provided here.

Furthermore, it can preferably be provided that the pre-tension 7, 8, 9 is set or varied according to a predefinable continuous course 14 over a longitudinal extension or within a playing range of the string core 2. A fluid transition of the properties of the musical string 1 is thus achieved.

Figure 3:
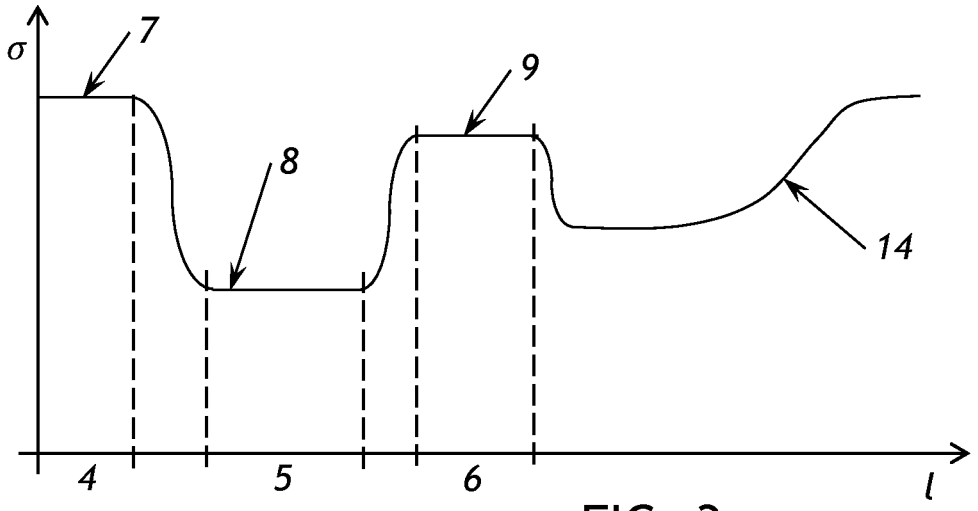
FIG. 3 shows an example of a course of the pre-tension during the production over the length of the string core.

FIG. 3 shows a course of the pre-tension 7, 8, 9 over the longitudinal extension 1 of the musical string 1. This is solely an illustration of the principle here. In the left region of the curve, three rapid regions 7, 8, 9 are shown, each connected by a short transition region. A continuous or fluid course 14 is shown in the right region of the curve.

The amount of the variation of the pre-tension 7, 8, 9, 14 is only subjected to limits as such by the possibilities of the material of the string core 2 and the machines used. However, it has proven to be advantageous in practice if the second pre-tension 8 is set at most 100% different from the first pre-tension 7.

Upon variation of the pre-tension force, the respective values are furthermore also extremely dependent, in addition to the material of the string core 2, on the cross section of the string core 2, which is in turn dependent on the desired tuning tone and on the instrument. Values between 5 N and 400 N are typical for the first pre-tension force and/or second pre-tension force to be applied. The large value range results from musical strings 1 for different instruments. Musical strings having 400 N are thus provided for bass violins.

The present invention is preferably not restricted to two different longitudinal sections 4, 5 having two different pre-tensions 7, 8. Rather, it is preferably provided that during the winding of a third longitudinal section 6 of the string core 2, which is different from the first longitudinal section 4 and from the second longitudinal section 5, using the first winding element 3, a third pre-tension 9, which is different from the first pre-tension 7 and the second pre-tension 8, is applied to the string core 2. Still further longitudinal sections having different pre-tensions 7, 8, 9, 14 can particularly preferably also be provided. Furthermore, different longitudinal sections 4, 5, 6 can also be wound using equal pre-tension 7, 8, 9, 14.

In the scope of the present disclosure, features are typically introduced with an indefinite article "a, an". If not indicated otherwise from the context, this indefinite article is not to be understood as a numeric specification, so that the disclosure is not restricted to only one occurrence of the respective feature.

Furthermore, "or" is to be interpreted as inclusive and not as exclusive. In the case of two generic terms "A" and/or "B", therefore "A or B" does not exclude the option "A and B", unless it results from the context or the present description that only one of the two generic terms "A" and "B" is provided.

Furthermore, it does not necessarily follow from the use of an ordinal number, such as first, second, third, etc., which precedes a feature, that there is a group of the relevant feature.

The invention claimed is:

1. A method for producing a musical string, comprising:

winding at least one first winding element on a string core of the musical string in a helical line around the string core;

applying, during winding of a first longitudinal section of the string core using the at least one first winding element, a first pre-tension to the string core; and applying, during winding of a second longitudinal section of the string core using the at least one first winding element, a second pre-tension to the string core, the second longitudinal section being different from the first longitudinal section, the second pre-tension being different from the first pre-tension.

2. The method according to claim 1, wherein a change is made from the first pre-tension to the second pre-tension during the continuous winding using the at least one first winding element.

3. The method according to claim 1, wherein the second pre-tension is set at most 100% different from the first pre-tension.

4. The method according to claim 1, wherein the first pre-tension is applied by loading the string core using a first pre-tension force, and the second pre-tension is applied by loading the string core using a second pre-tension force.

5. The method according to claim 4, wherein at least one of the first pre-tension force and the second pre-tension force is set to a value between 5 N and 400 N.

6. The method according to claim 1, wherein a string core is selected which has an elongation at fracture of at least 3%.

7. The method according to claim 1, wherein a string core is selected which has a modulus of elasticity of less than 100 GPa.

8. The method according to claim 1, wherein the first longitudinal section and the second longitudinal section are formed essentially directly adjoining one another.

9. The method according to claim 1, wherein the pre-tension is set according to a predeterminable continuous course over a longitudinal extension of the string core.

10. The method according to claim 1, wherein during the winding of a third longitudinal section of the string core, which is different from the first longitudinal section and from the second longitudinal section, using the at least one first winding element, a third pre-tension, which is different from the first pre-tension and the second pre-tension, is applied to the string core.

11. The method according to claim 1, wherein at least one second winding element is wound in the form of a further helical line around the string core.

12. A musical string, comprising:

at least one supporting string core; and at least one first winding element wound in a helical line around the at least one supporting string core forming adjacent turns;

wherein in a first longitudinal section of the musical string, one of a first contact pressure force and a first distance between the adjacent turns prevails, and in a second longitudinal section one of a second contact pressure force and a second distance between the adjacent turns prevails, the second longitudinal section being different from the first longitudinal section; and wherein one of the second contact pressure force is different from the first contact pressure force and the second distance is different from the first distance.

13. The musical string according to claim 12, wherein the musical string is for at least one of bowed and plucked instruments.

14. The musical string according to claim 12, wherein the string core comprises at least one of a plastic thread, a wire cable, a natural gut, an artificial gut, a plastic strip, and a plastic flat strip.

15. The musical string according to claim 12, wherein the string core has an elongation at fracture of at least 3%.

16. The musical string according to claim 12, further comprising at least one second winding element wound in the form of a further helical line around the string core.

* * * * *